US006598771B2

(12) United States Patent
Norman

(10) Patent No.: US 6,598,771 B2
(45) Date of Patent: Jul. 29, 2003

(54) INFANT CARRIER

(75) Inventor: Lisa C. Norman, Solana Beach, CA (US)

(73) Assignee: Infantino, San Diego, CA (US)

( * ) Notice: Subject to any disclaimer, the term of this patent is extended or adjusted under 35 U.S.C. 154(b) by 0 days.

(21) Appl. No.: 09/864,910

(22) Filed: May 24, 2001

(65) Prior Publication Data

US 2002/0175194 A1 Nov. 28, 2002

(51) Int. Cl.[7] ..... A61G 1/00

(52) U.S. Cl. ..... 224/160; 224/181; 224/576; 224/644; 224/646

(58) Field of Search ..... 224/159, 160, 224/576, 181, 644, 646

(56) References Cited

U.S. PATENT DOCUMENTS

| | | | | |
|---|---|---|---|---|
| 3,780,919 A | * | 12/1973 | Hansson | 224/160 |
| 4,333,591 A | * | 6/1982 | Case | 224/160 |
| 5,246,152 A | * | 9/1993 | Dotseth | 224/158 |
| 5,791,535 A | * | 8/1998 | Roan et al. | 224/153 |
| 5,813,580 A | * | 9/1998 | Fair | 224/160 |
| 5,848,741 A | * | 12/1998 | Fair | 224/160 |
| 6,409,060 B2 | * | 6/2002 | Donine | 224/160 |

OTHER PUBLICATIONS

Theodore Bean Adventure Company Inc., Standard Baby Carrier, Aug. 17, 2001, theodorebean.com web site.

Theodore Bean Adventure Company Inc., Black Leather Baby Carrier, Aug. 17, 2001, theodorebean.com web site.

Theodore Bean Adventure Company Inc., Micro–Mesh Baby Carrier, Aug. 17, 2001, theodorebean.com web site.

Theodore Bean Adventure Company Inc., Deluxe Carrier, Aug. 17, 2001, theodorebean.com web site.

Theodore Bean Adventure Company Inc., Brown Leather Baby Carrier, Aug. 17, 2001, theodorebean.com web site.

Evenflo Company Inc., Out & About Soft Carrier, Aug. 17, 2001, snugli.com web site.

Evenflo Company Inc., Double Take Soft Carrier, Aug. 17, 2001, snugli.com web site.

Evenflo Company Inc., Double Comfort Soft Carrier, Aug. 17, 2001, snugli.com web site.

Evenflo Company Inc., Easy Comfort Plus Front & Back Pack Soft Carrier, Aug. 17, 2001, snugli.com web site.

Evenflo Company Inc., Comfort Supreme Soft Carrier, Aug. 17, 2001, snugli.com web site.

Evenflo Company Inc., Porte Bébé Premier Soft Carrier, Aug. 17, 2001, snugli.com web site.

Babybjörn AB, Baby Carrier, Aug. 17, 2001, babybjorn.com web site.

Babybjörn AB, Baby Björn Front Carrier, Aug. 17, 2001, store4baby.com web site.

* cited by examiner

*Primary Examiner*—Stephen K. Cronin
(74) *Attorney, Agent, or Firm*—Stetina Brunda Garred & Brucker

(57) ABSTRACT

An infant carrier configured to be worn by a wearer is disclosed. The infant carrier includes a seat support configured to support an infant's bottom, a back support, which is integral with the seat support, a head support which is integral with the back support and a strap support system which is worn around the wearer's torso to support the infant in the infant carrier. The seat support is diaper-like in shape with a front notch to prevent chafing the infant. Preferably, the strap support system is made up of a single pair of straps. Preferably, there is a separation (e.g., a seam) between the back support and the head support which allows the head support to be folded down when not being used to support the infant's head.

29 Claims, 10 Drawing Sheets

INFANT CARRIER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to carrying devices for infants and small children, and more particularly to an improved, infant carrier which is more comfortable for the infant and the wearer.

It is common practice for a parent to employ the use of a baby carrier for carrying an infant. Indeed, various types of baby carriers are currently available from manufacturers of infant products. Though such currently known and available baby carriers achieve their primary objective of carrying an infant, they possess certain deficiencies which detract from their overall utility.

Of primary concern is support and safety of the infant. One of the key concerns with regard to support of the infant is support of the infant's head. A young infant's head tends to flop around and therefore requires support. As the child gets older, he/she can hold up his/her own head. Due to the fluctuating need for head support, a head support may be desired only some of the time. Thus, infant carriers with removable head rests (for example, see U.S. Pat. No. 5,246,152, issued to Dotseth) have been developed. While an improvement over the prior art, infant carriers with removable head rests are limited in that if the headrest is removed, it must be carried separately or left at another location where it is not readily accessible. Thus, a need exists for an infant carrier with a "convertible" headrest or head support such that the headrest can be used if desired, but can also not be used without actually having to remove it.

Another area of typical discomfort for infants being carried in an infant carrier is chafing of the infant in the neck area (e.g., under the chin). Typical infant carriers include a seat support portion which holds the child's bottom. This seat support area typically looks like a diaper, in that it is triangular in shape and includes leg openings for the infant's legs to protrude from. Like a diaper, the seat support of infant carriers tend to have a top portion that extends linearly across the child's chest. However, unlike a diaper, the infant carrier must be constructed of a more durable, less flexible fabric than a diaper in order to provide support. Thus, since infants and small children have a tendency to lean forward (towards the wearer) when in a typical infant carrier device, there is a tendency for the area of the infant's neck under its chin to be firmly engaged against the top portion of the seat support of such carrier, often resulting in the chaffing of the infant's neck and, in extreme cases, difficulty in breathing. Thus, a need exists for an infant carrier which will not interfere with the neck of an infant or small child that is leaning forward and/or has its head sagging downwardly in a forward facing position.

Another area of concern is the comfort and ease of use (e.g., putting on, adjusting and removing the carrier) for the wearer (e.g., parent). Typical infant carriers include many straps and buckles which are often difficult for a wearer to put on and/or take off. These devices are not always easy to adjust. Furthermore, it is often difficult for wearers to adjust such infant carriers so that they are comfortable for the wearer. Thus, a need exists for a strap system which provides for secure carrying of the infant, yet is easy for the wearer to put on, take off and adjust. Furthermore, the strap system should be comfortable for the wearer.

The present invention addresses the above described deficiencies in the prior art by providing an infant carrier which is safe and provides proper support for the infant, yet is more comfortable for the child. Additionally, the infant carrier is comfortable for the wearer and easily adjustable.

BRIEF SUMMARY OF THE INVENTION

In accordance with the present invention, there is provided an infant carrier which is configured to be worn by a wearer. The infant carrier comprises a seat support which is configured to support the infant's bottom. The seat support includes two openings for the infant's legs and defines a front having a notch formed therein which is sized and configured to provide clearance for the infant's head when the infant is in the infant carrier. The notch preferably has a generally V-shaped configuration defining first and second sides which meet at a point. In addition to the seat support, the infant carrier includes a back support which is integral with the seat support and configured to support the infant's back. Also included in the infant carrier is a head support which is integral with the back support and configured to support the infant's head. Attached to the seat support is a strap support system which is adapted to be worn around the wearer's torso.

In the present infant carrier, a transition region or seam is defined between the back and head supports. The transition region is sized and configured to allow the head support to be selectively moved between an unfolded position and a folded position. When the head support is moved into the folded position, it is folded down into an overlapping relation to the back support, thus exposing the head, shoulders and upper portion of the torso of the infant. The head support preferably includes a pouch which is selectively movable between an open position and a closed position. Disposed within the pouch is a deployable hood which is attached to the head support, as well as a deployable shroud which is also attached to the head support. The hood, when deployed, is positionable over the infant's head within the infant carrier. The shroud, when deployed, is itself placable over the entirety of the infant carrier having the infant positioned therewithin.

In the present infant carrier, the strap system comprises an elongate first strap having a first end portion which is attached to the seat support adjacent the first side of the notch. Disposed on the first strap is a first connector piece which is normally located in close proximity to the second, free end of the first strap. The strap support system also includes an elongate second strap having a first end portion which is itself attached to the seat support adjacent the second side of the notch. Disposed on the second strap is a second connector piece which is normally disposed in relative close proximity to the second, free end of the second strap. Attached to the seat support adjacent the second side of the notch is a first mating connector, while also attached to the seat support adjacent the first side of the notch is a second mating connector. The first and second straps are extensible over the wearer's shoulders in a manner wherein the first and second straps criss-cross each other over the wearer's back such that the first connector piece may be interlocked to the first mating connector and the second connector piece may be interlocked to the second mating connector.

The infant carrier of the present invention further comprises a first row of snap bases which are attached to the first strap and a second row of snap bases which are attached to the second strap. Also attached to the first strap is a first strip of material having a first row of snap connectors attached thereto. The first strip of material is attached to the first strap such that the snap connectors of the first row are selectively engagable to respective ones of the snap bases of the first row. Attached to the second strap is a second strip of material which has a second row of snap connectors attached thereto. The second strip of material is attached to the second strap such that the snap connectors of the second row are selectively engagable to respective ones of the snap bases of the first row.

In the infant carrier of the present invention, a pair of swivel connectors are preferably used to attach respective ones of the first and second straps to the head support. The swivel connectors are adapted to assist in the movement of the head support between its unfolded and folded positions. The first swivel connector includes a first connector ring which may be selectively captured between any adjacent pair of engaged snap connectors and snap bases of the first rows. Similarly, the second swivel connector includes a second connector ring which may be selectively captured between any adjacent pair of engaged snap connectors and snap bases of the second rows.

BRIEF DESCRIPTION OF THE DRAWINGS

These as well as other features of the present invention will become more apparent upon reference to the drawings wherein.

DETAILED DESCRIPTION OF THE INVENTION

Figure 1:
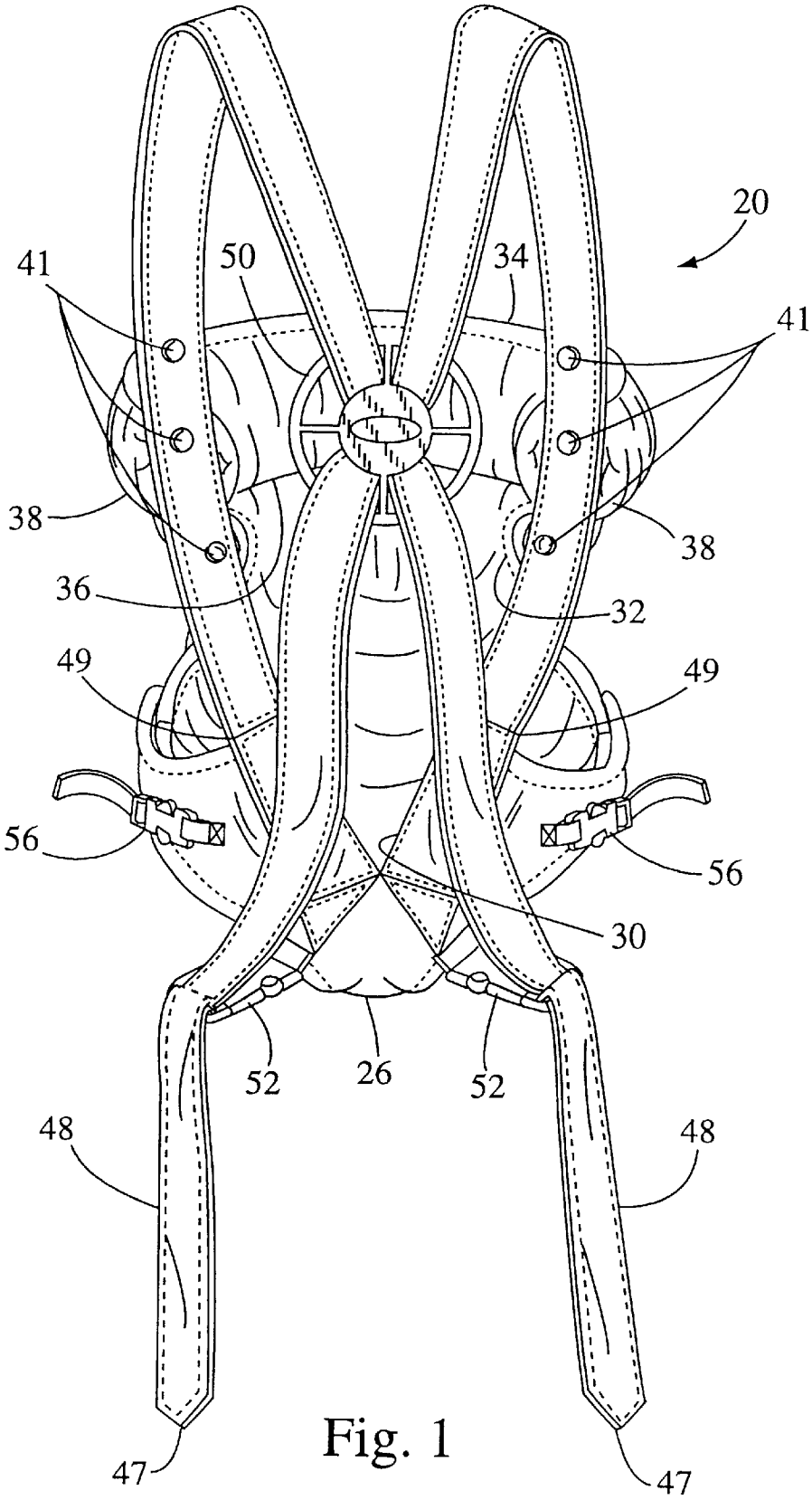
FIG. 1 is a front elevational view of a baby carrier constructed in accordance with the present invention.
Figure 2:
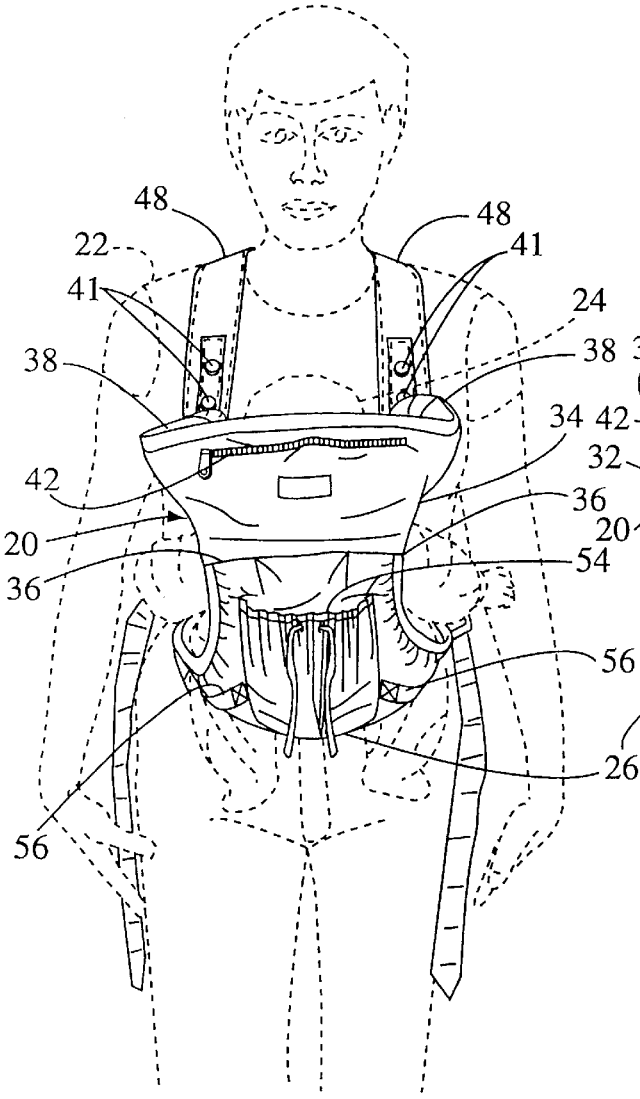
FIG. 2 is a rear elevational view of the baby carrier constructed in accordance with the present invention shown in the manner in which the present baby carrier is normally used to facilitate the carrying of an infant or small child by a wearer.
Figure 3:
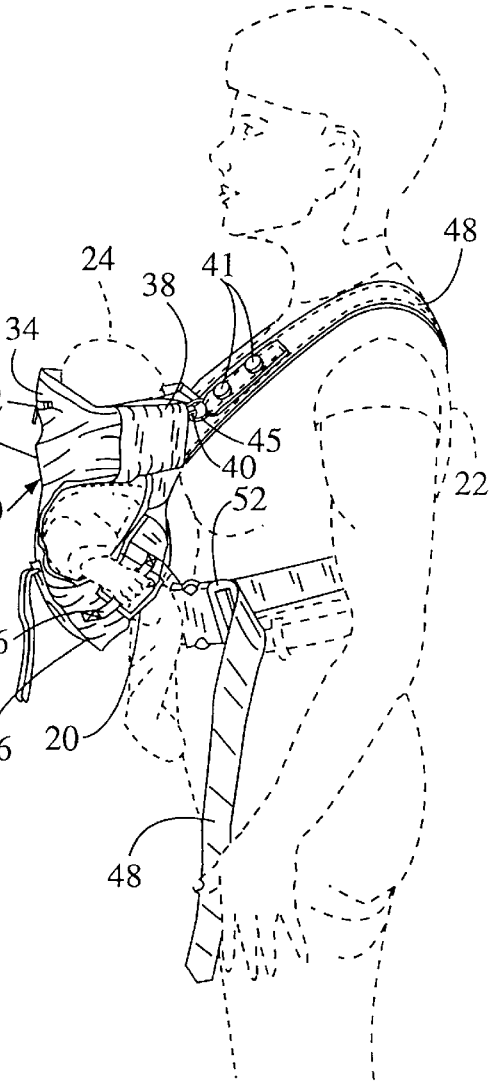
FIG. 3 is a side elevational view of the baby carrier constructed in accordance with the present invention shown in the manner in which the present baby carrier is normally used to facilitate the carrying of an infant or small child by a wearer.
Figure 4:
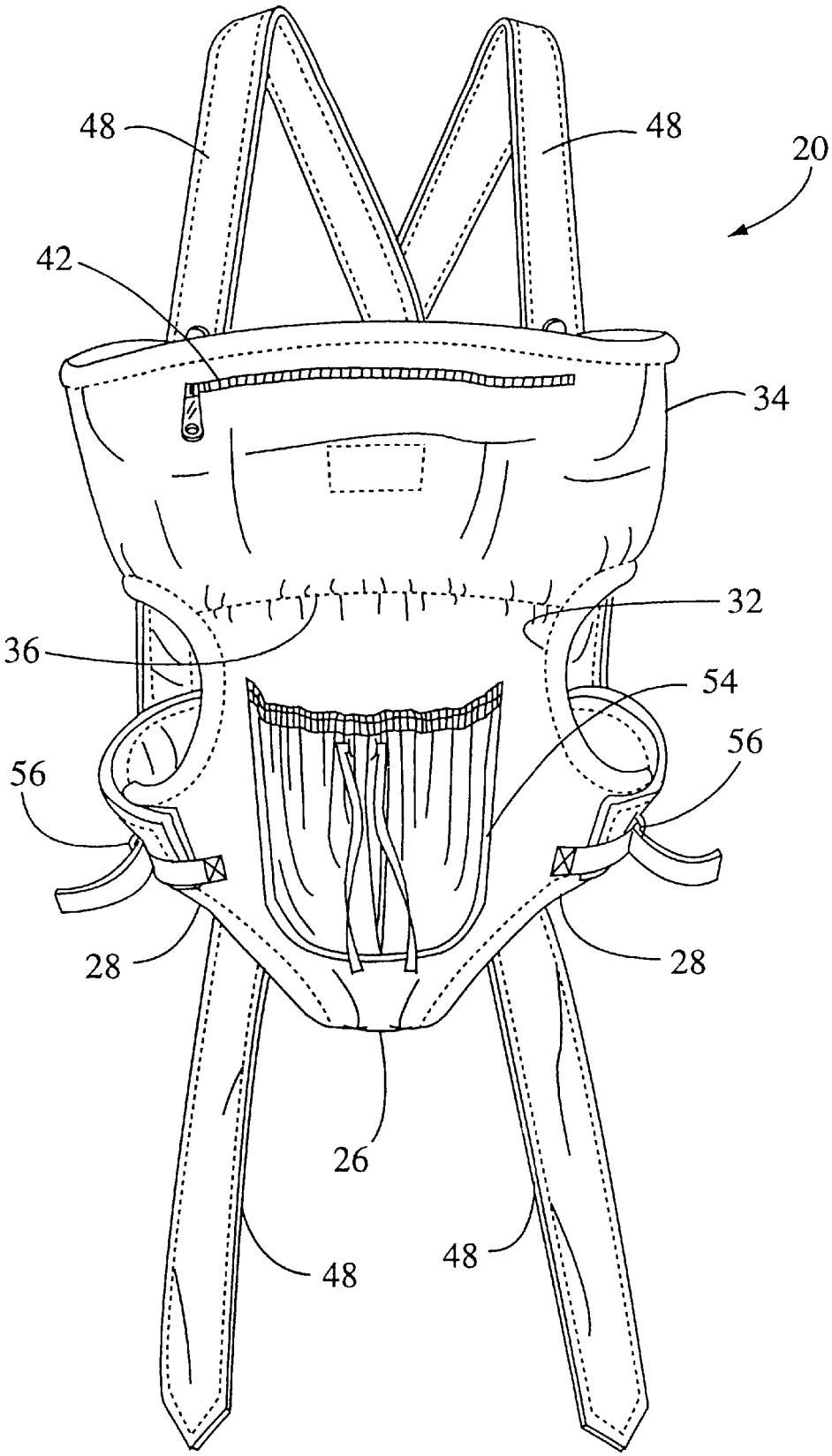
FIG. 4 is a rear elevational view of the baby carrier constructed in accordance with the present invention.

Referring now to the drawings wherein the showings are for purposes of illustrating a preferred embodiment of the present invention only, and not for purposes of limiting same, FIG. 1 is a front elevational view illustrating an infant carrier 20 constructed in accordance with the present invention. FIGS. 4–7 are a rear elevational, a side elevational, a top plan and a bottom plan view of the infant carrier shown in FIG. 1, respectively. As indicated above, the infant carrier 20 is adapted to accommodate an infant or small child to facilitate the carrying of the infant in the manner shown in FIGS. 2 and 3. Those of ordinary skill in the art will recognize that the infant carrier 20 may be formed to have a variety of shapes, configurations, geometries, sizes and textures other than for that shown in the figures and described herein.

Preferably, the infant carrier 20 is essentially comprised of a carrying device which supports an infant 24 and a strap system which is attached to the carrying device and is used to secure the carrying device to a wearer 22 (e.g., an adult carrying the infant 24). The carrying device comprises a seat support 26, a back support 32 and a head support 34. Preferably, the seat support 26, back support 32 and head support 34 are a single-piece construction. In exemplary embodiments, the inside of the carrying device (portion that the infant 24 rests against) is made of a cotton or cotton blend material (e.g., jersey or flannel) and the outer covering is made of a polyester fiber/cotton blend (for example 65% polyester fiber/35% cotton). The inside portion and outer covering are sewn together and include a filling between them which cushions the infant 24. In exemplary embodiments, the filling is a blend of polyester fiber and urethane foam (for example, 75% polyester fiber/25% urethane foam). It will be appreciated that different materials or blends of various materials may be used in various embodiments.

The seat support 26 includes two leg openings 28 through which the infants legs protrude when the infant 24 is in the infant carrier 20. In typical prior art infant carriers, the top of the seat support portion is linear (e.g., diaper-like in shape). However, unlike a diaper which is made of a flexible material, the seat support of an infant carrier must be constructed of a less flexible material than a diaper in order to provide adequate support for carrying the infant. Since infants tend to lean forward and the heads of infants tend to sag downwardly in a forward position, the infant's neck may be chafed by the top of the front of the seat support. In exemplary embodiments of the present invention, the front of the seat support 26 includes a notch 30 so that a supportive material can be used without the seat support 26 engaging the neck of the infant. In exemplary embodiments, an attachment device (e.g., snaps) is provided so that a removable bib (not shown) may be placed in the notched area 30 if desired.

In various embodiments of the present invention, there are seat support adjusters 56 which are used to tighten or loosen that seat support 26 about the infant 24. In exemplary embodiments, the seat support adjusters 56 include a dual fastening system for added security (for example, both a velcro fastener and a buckle fastener). Exemplary embodiments include plastic buckle fasteners, however, it will be appreciated that other materials can be used for a buckle. It will also be appreciated that other types of fasteners can be used (for example, snaps may be used instead of velcro).

Figure 5:
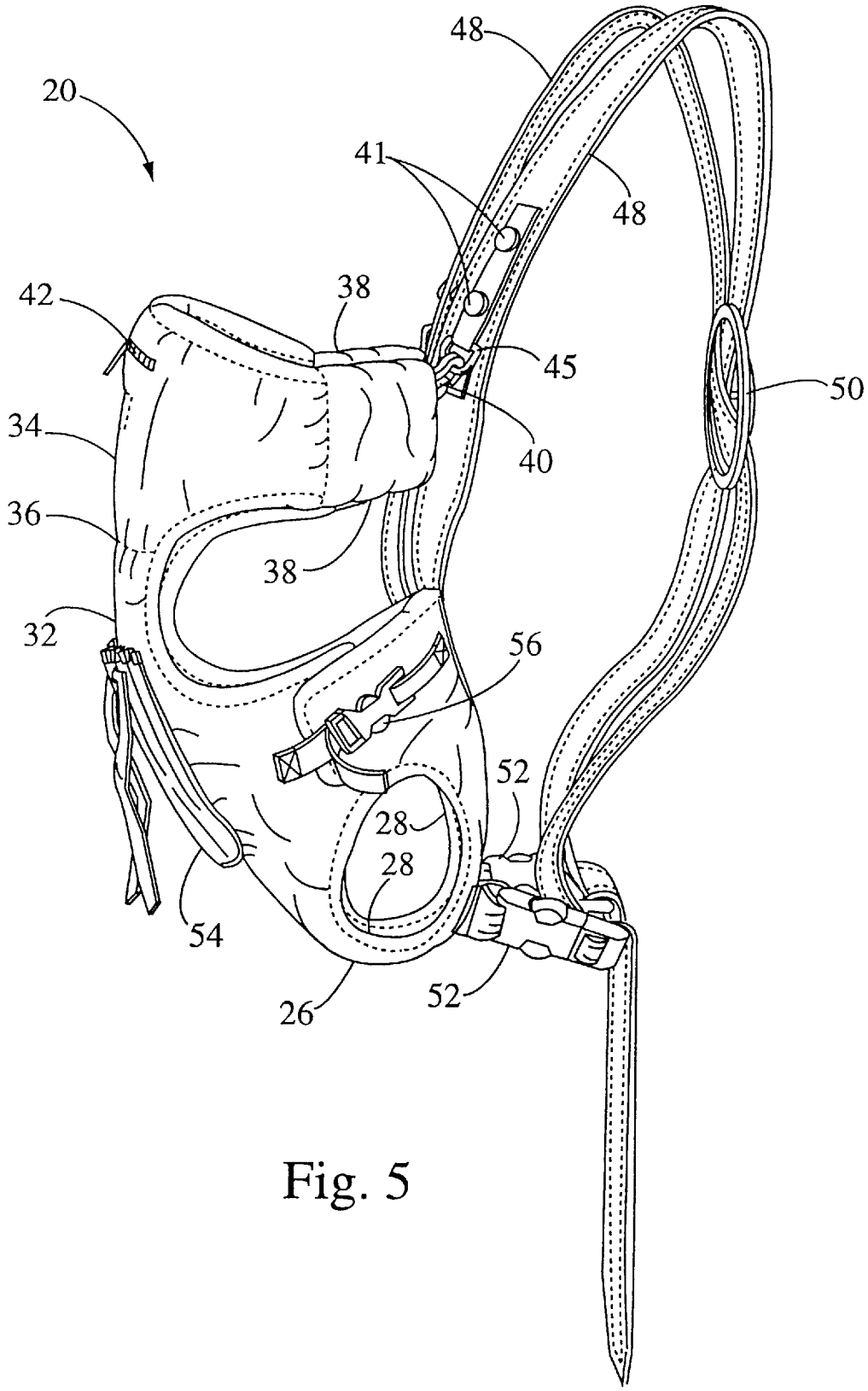
FIG. 5 is a side elevational view of the baby carrier constructed in accordance with the present invention.
Figure 6:
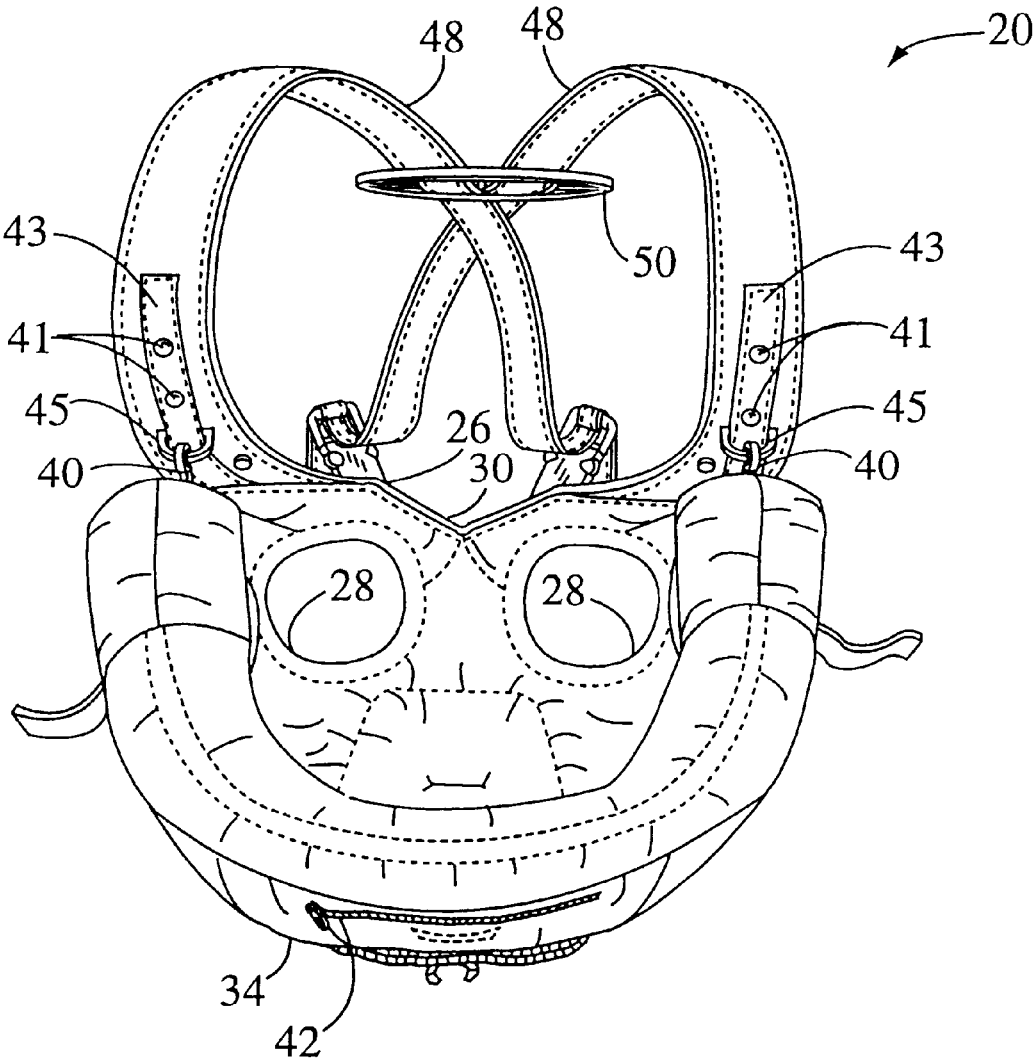
FIG. 6 is a top plan view of the baby carrier constructed in accordance with the present invention.
Figure 7:
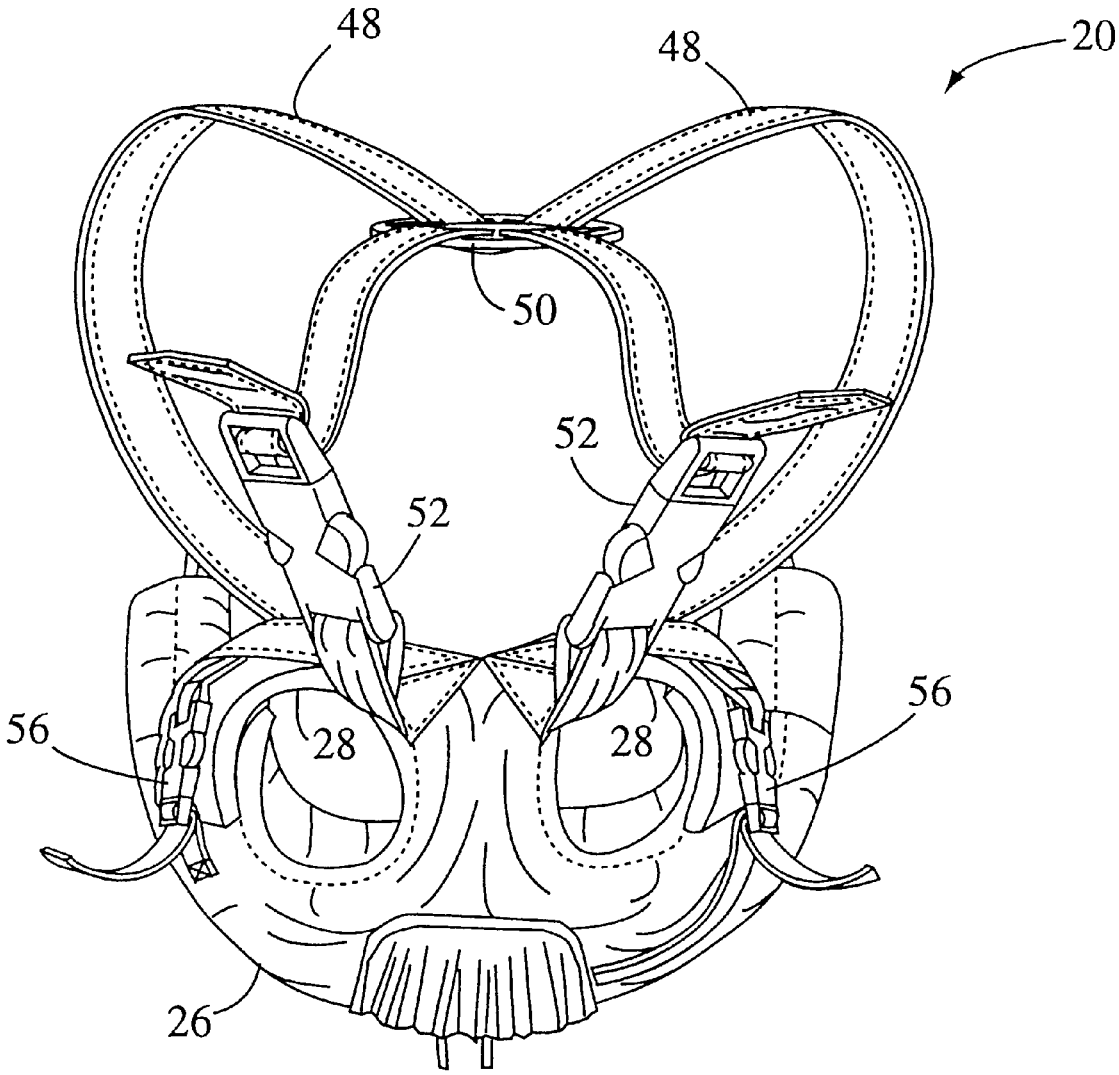
FIG. 7 is a bottom plan view of the baby carrier constructed in accordance with the present invention.
Figure 8:
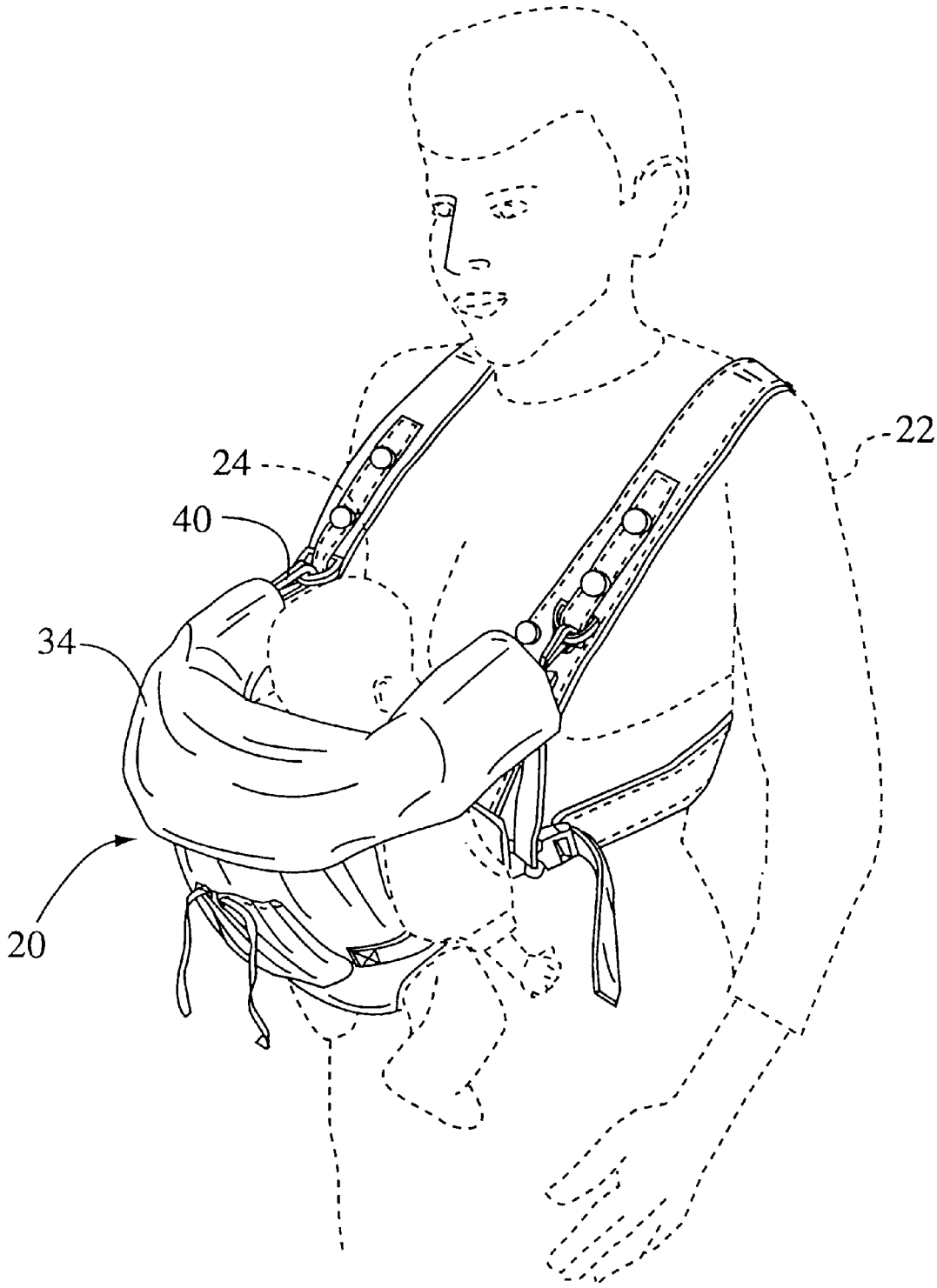
FIG. 8 is a rear left elevational view of the baby carrier constructed in accordance with the present invention being worn by a wearer (with the wearer being shown in a right front elevational view) with the headrest folded down (i.e., not being used)
Figure 9:
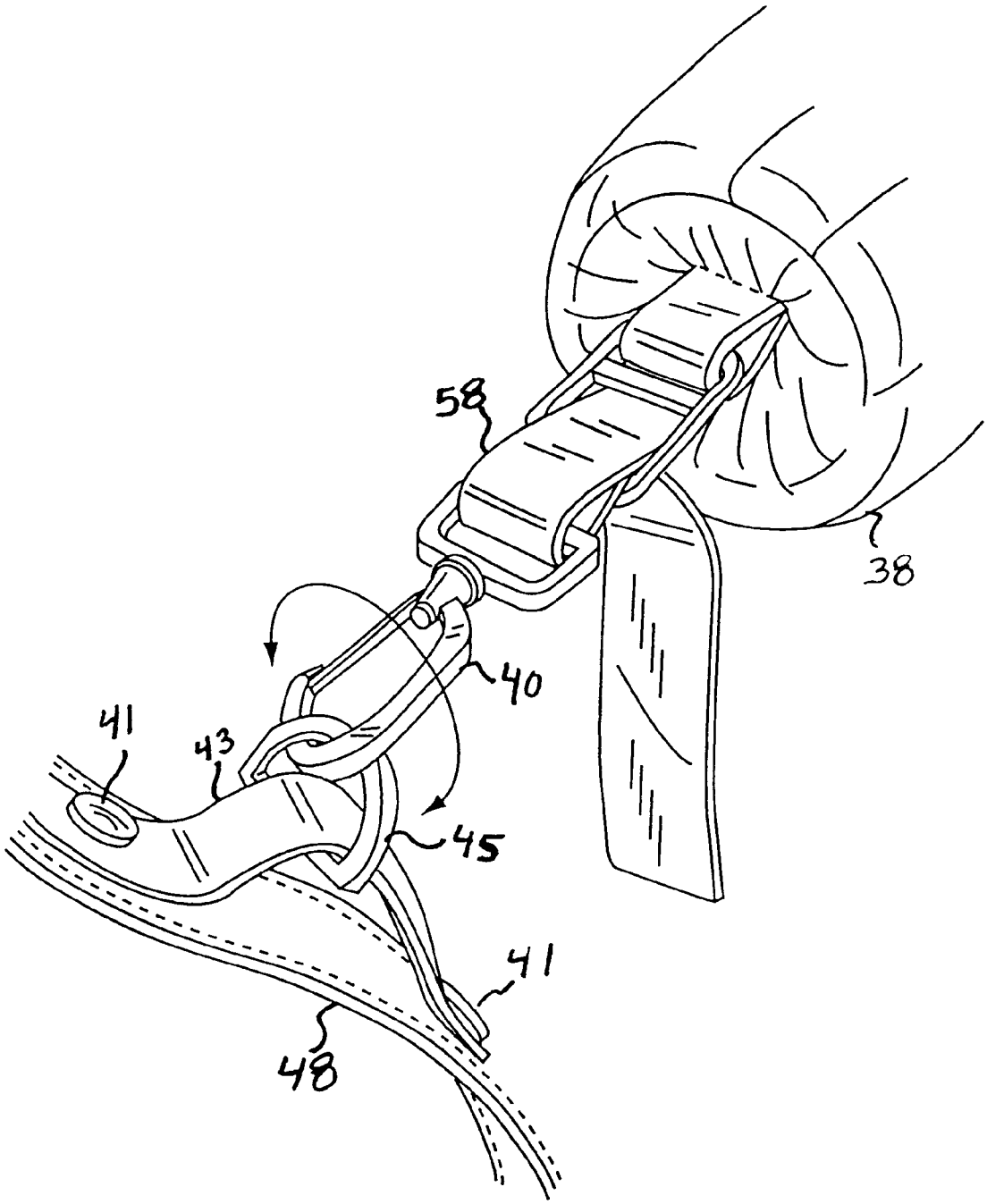
FIG. 9 is an exploded view which shows a swivel interconnect which is attached to the headrest of the baby carrier constructed in accordance with the present invention in order to facilitate turning down the head rest as shown in FIG. 8.

The back support portion 32 and head support portion 34 are separated by a seam 36 which allows the head support to be folded down as shown in FIG. 8. Thus, the present invention includes a "convertible headrest" which essentially allows the headrest to be used or not be used without actually having to remove and attach the headrest. In exemplary embodiments, head support 34 is elongated in shape to include tapered ends 38. Preferably, a swivel interconnect 40 is attached to each of the ends 38 of the head support 34 as shown in FIG. 5. An adjustable strap 58 may be attached to the end of the head rest 38 (e.g., sewn in) and a swivel interconnect 40 (e.g., plastic) is connected to the strap. The swivel interconnect 40 facilitates folding the headrest 34 at seam 36.

Figure 10:
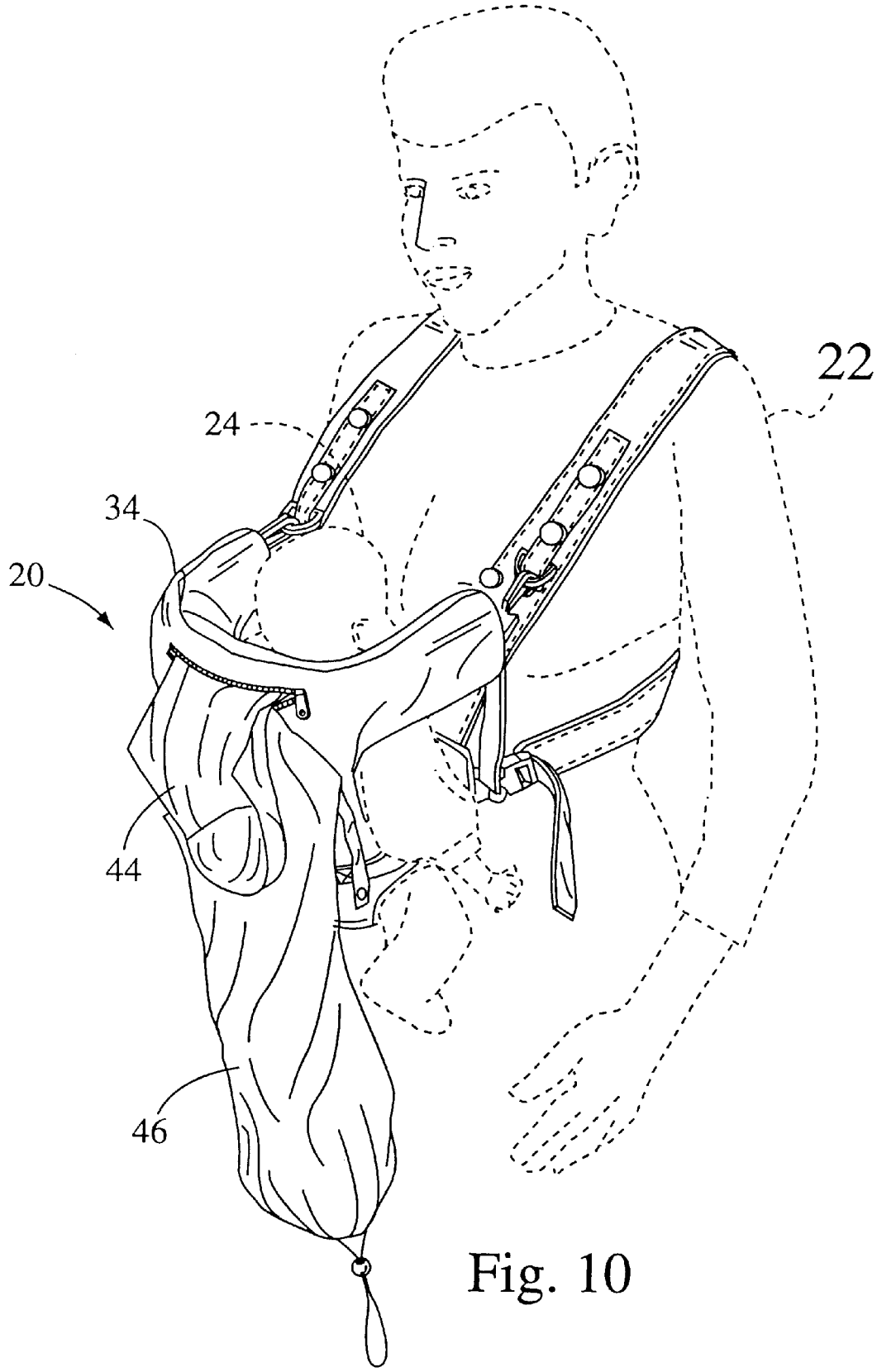
FIG. 10 illustrates an exemplary embodiment of the present invention wherein the headrest includes a pouch having a hood and a shroud disposed therein.
Figure 11:
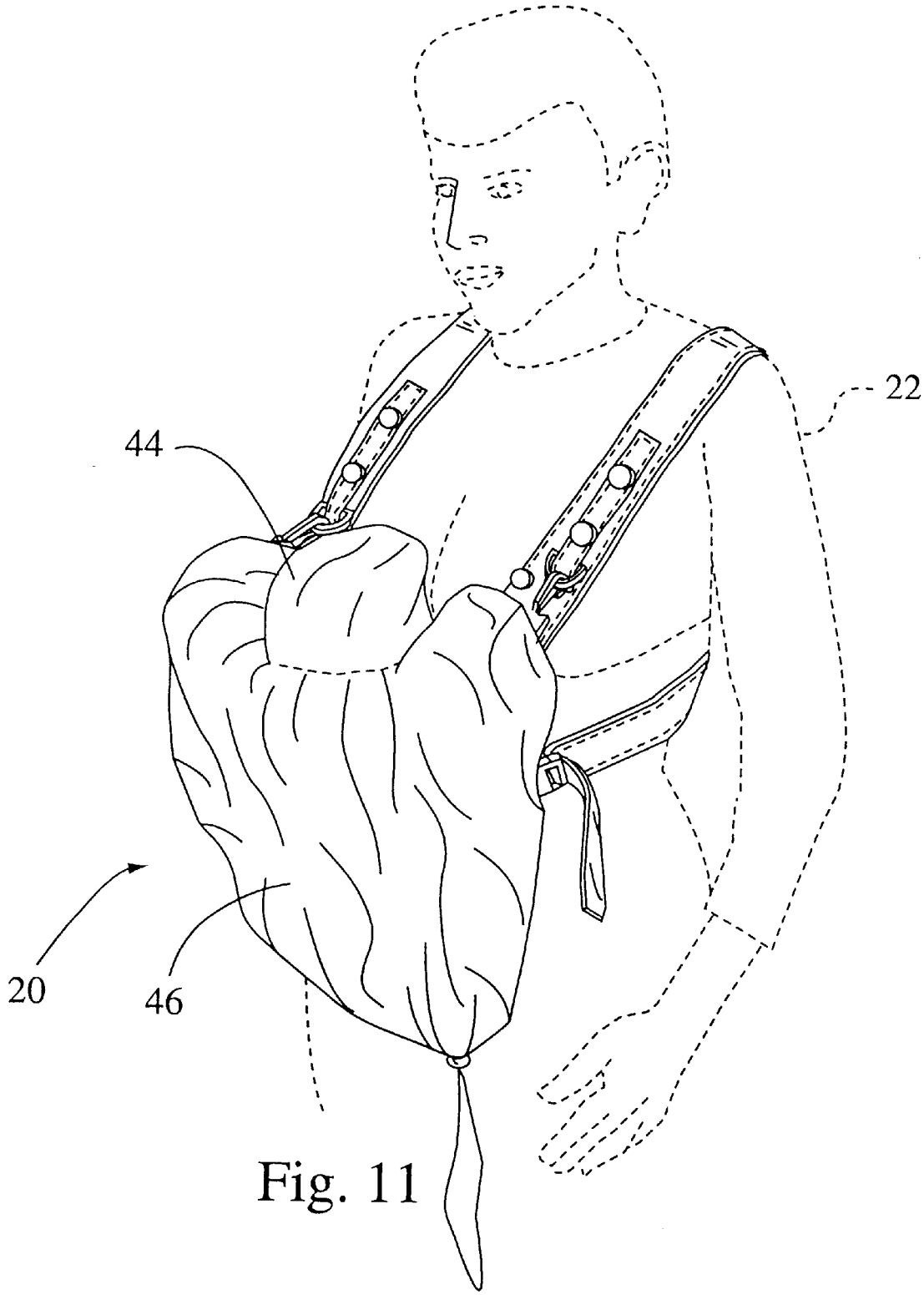
FIG. 11 illustrates an exemplary embodiment of the present invention wherein the hood and shroud shown in FIG. 10 are being worn by (i.e., are covering) the infant.

In exemplary embodiments, the head support 34 includes a pouch. The pouch includes an opening which may be opened and closed using a device such as a zipper 42. In exemplary embodiments, a hood 44 and/or shroud 46 are located inside the pouch and attached to the head support as shown in FIG. 10. Thus, the hood 44 can be easily removed and placed over the infant's head and/or the shroud 46 can be easily removed and used to cover the infant's body as shown in FIG. 11. In exemplary embodiments, additional storage is provided by a pouch 54 located on the back support portion 32.

Traditional infant carriers are secured to the wearer with a strap system comprised of several pairs of straps. In exemplary embodiments, the present invention employs a strap system which uses only a single pair of straps 48. The use of a single pair of straps 48 makes it easy for the wearer 22 to put on and take off the infant carrier 20. Additionally, the single-pair strap system is more comfortable and easier to adjust than a system with multiple pairs of straps. As shown in the figures, there are two straps 48, with each strap having a free end 47 and a connecting end 49 which is attached (e.g., sewn) to the seat support 26 as can be seen in FIG. 1. With the infant carrier 20 placed on the wearer's chest, each strap 48 goes over one of the wearer's shoulders. The straps 48 are crossed at the wearer's back, for example using a strap ring 50. The infant carrier 20 is then secured to the wearer 22, for example, by latching belt connectors 52. One end of the belt connector 52 is attached to the seat support 26 (e.g., one side of a belt connector is attached to each side of the seat support 26 near the point of the notch 30). The mating ends for the belt connector are located near the free end of the straps 48, and preferably can be adjusted by sliding them along the straps 48.

In exemplary embodiments, the infant carrier 20 can further be easily adjusted using snaps 41 located on the straps. Preferably, a connector strap 43 (shown in FIG. 6) is attached (e.g., sewn) to each strap 48 at the location on the strap that lays against the wearer's chest. Each of the connector straps 43 includes multiple (e.g., three) snaps 41. A ring 45 is connected to pivot clip 40 and is looped through connecting strap 43. Thus, the straps 48 can be adjusted by simply unsnapping one or more snaps 41, sliding the ring 45 to the desired location and re-snapping the snaps 41. Thus, the snaps 41 allow the wearer 22 to easily position the infant carrier 20 higher or lower on the wearer's chest.

Additional modifications and improvements of the present invention may also be apparent to those of ordinary skill in the art. Thus, the particular combination of parts described and illustrated herein is intended to represent only a certain embodiment of the present invention, and is not intended to serve as a limitation of alternative devices within the spirit and scope of the invention.

What is claimed is:

1. An infant carrier configured to be worn by a wearer, the infant carrier comprising:

a seat support configured to support an infant's bottom, the seat support including two openings for the infant's legs and defining a front having a top edge and an upwardly opening V-shaped notch formed therein which extends to the top edge and has a lower apex;

a back support which is integral with the seat support and configured to support the infant's back;

a head support which is integral with the back support and configured to support the infant's head; and a strap support system attached to the seat support and adapted to be worn around the wearer's torso.

2. The infant carrier of claim 1 wherein the notch within the seat support defines first and second sides, and the strap support system comprises:

an elongate first strap having a first end portion attached to the seat support adjacent the first side of the notch and a second end;

a first connector piece disposed on the first strap in close proximity to the second end thereof;

an elongate second strap having a first end portion attached to the seat support adjacent the second side of the notch and a second end;

a second connector piece disposed on the second strap in close proximity to the second end thereof;

a first mating connector attached to the seat support adjacent the second side of the notch; and a second mating connector attached to the seat support adjacent the first side of the notch;

the first and second straps being extensible over the wearer's shoulders in a manner wherein the first and second straps criss-cross each other over the wearer's back such that the first connector piece may be interlocked to the first mating connector and the second connector piece may be interlocked to the second mating connector.

3. The infant carrier of claim 2 further comprising a transition region which is defined between the back and head supports and is sized and configured to allow the head support to be selectively moved between an unfolded position and a folded position whereat the head support is folded down into an overlapping relation to the back support.

4. The infant carrier of claim 3 further comprising first and second swivel connectors used to attach respective ones of the first and second straps to the head support and adapted to assist in the movement of the head support between the unfolded and folded positions.

5. The infant carrier of claim 4 further comprising:

a first row of snap bases attached to the first strap;

a first strip of material having a first row of snap connectors attached thereto, the first strip of material being attached to the first strap such that the snap connectors of the first row are selectively engagable to respective ones of the snap bases of the first row;

a second row of snap bases attached to the second strap; and a second strip of material having a second row of snap connectors attached thereto, the second strip of material being attached to the second strap such that the snap connectors of the second row are selectively engagable to respective ones of the snap bases of the second row;

the first swivel connector including a first connector ring which may be selectively captured between any adjacent pair of engaged snap connectors and snap bases of the first rows, and the second swivel connector including a second connector ring which may be selectively captured between any adjacent pair of engaged snap connectors and snap bases of the second rows.

6. The infant carrier of claim 1 wherein the head support includes a pouch with an opening selectively movable between an open position and a closed position.

7. The infant carrier of claim 6 further comprising a deployable hood which is disposed within the pouch and attached to the head support.

8. Then infant carrier of claim 6 further comprising a deployable shroud which is disposed within the pouch and attached to the head support.

9. An infant carrier configured to be worn by a wearer, the infant carrier comprising:

a seat support configured to support an infant's bottom and defining first and second sides, the seat support including two openings for the infant's legs and defining a front having a top edge and an upwardly opening V-shaped notch formed therein which extends to the top edge and has a lower apex;

a back support which is integral with the seat support and configured to support the infant's back;

a head support which is integral with the back support and configured to support the infant's head; and a strap support system which is attached to the seat support and adapted to be worn around the wearer's torso, the strap support system comprising:

an elongate first strap having a first portion attached to the first side of the seat support and a second end;

a first connector piece disposed on the first strap in close proximity to the second end thereof;

an elongate second strap having a first end portion attached to the second side of the seat support and a second end;

a second connector piece disposed on the second strap in close proximity to the second end thereof;

a first mating connector attached to the second side of the seat support; and a second mating connector attached to the first side of the seat support;

the first and second straps being extensible over the wearer's shoulders in a manner wherein the first and second straps criss-cross each other over the wearer's back such that the first connector piece may be interlocked to the first mating connector and the second connector piece may be interlocked to the second mating connector.

10. The infant carrier of claim 9 further comprising:

a first row of snap bases attached to the first strap;

a first strip of material having a first row of snap connectors attached thereto, the first strip of material being attached to the first strap such that the snap connectors of the first row are selectively engagable to respective ones of the snap bases of the first row;

a second row of snap bases attached to the second strap;

a second strip of material having a second row of snap connectors attached thereto, the second strip of material being attached to the second strap such that the snap connectors of the second row are selectively engagable to respective ones of the snap bases of the second row; and first and second swivel connectors used to attach respective ones of the first and second straps to the head support, the first swivel connector including a first connector ring which may be selectively captured between any adjacent pair of engaged snap connectors and snap bases of the first rows, and the second swivel connector including a second connector ring which may be selectively captured between any adjacent pair of engaged snap connectors and snap bases of the second rows.

11. The infant carrier of claim 9 further comprising a transition region which is defined between the back and head supports and is sized and configured to allow the head support to be selectively moved between an unfolded position and a folded position whereat the head support is folded down into an overlapping relation to the back support.

12. The infant carrier of claim 11 further comprising first and second swivel connectors used to attach respective ones of the first and second straps to the head support and adapted to assist in the movement of the head support between the unfolded and folded positions.

13. The infant carrier of claim 9 wherein the head support includes a pouch with an opening selectively movable between an open position and a closed position.

14. The infant carrier of claim 13 further comprising a deployable hood which is disposed within the pouch and attached to the head support.

15. The infant carrier of claim 13 further comprising a deployable shroud which is disposed within the pouch and attached to the head support.

16. An infant carrier configured to be worn by a wearer, the infant carrier comprising:

a seat support configured to support an infant's bottom, the seat support including two openings for the infant's legs and defining a front having a notch formed therein which defines first and second sides and is sized and configured to provide clearance for the infant's head when the infant is in the infant carrier;

a back support which is integral with the seat support and configured to support the infant's back;

a head support which is integral with the back support and configured to support the infant's head, the head and back supports being separated by a transition region which is sized and configured to allow the head support to be selectively moved between an unfolded position and a folded position whereat the head support is folded down into an overlapping relation to the back support;

a strap support system attached to the seat support and adapted to be worn around the wearer's torso, the strap support system comprising:

an elongate first strap having a first end portion attached to the seat support adjacent the first side of the notch, and a second end;

a first connector piece disposed on the first strap in close proximity to the second end thereof;

an elongate second strap having a first end portion attached to the seat support adjacent the second side of the notch, and a second end;

a second connector piece disposed on the second strap in close proximity to the second end thereof;

a first mating connector attached to the seat support adjacent the second side of the notch; and a second mating connector attached to the seat support adjacent the first side of the notch;

the first and second straps being extensible over the wearer's shoulders in a manner wherein the first and second straps criss-cross each other over the wearer's back such that the first connector piece may be interlocked to the first mating connector and the second connector piece may be interlocked to the second mating connector;

first and second swivel connectors used to attached respective ones of the first and second straps to the head support and adapted to assist in the movement of the head support between the unfolded and folded positions.

17. The infant carrier of claim 16 further comprising:

a first row of snap bases attached to the first strap;

a first strip of material having a first row of snap connectors attached thereto, the first strip of material being attached to the first strap such that the snap connectors of the first row are selectively engagable to respective ones of the snap bases of the first row;

a second row of snap bases attached to the second strap; and a second strip of material having a second row of snap connectors attached thereto, the second strip of material being attached to the second strap such that the snap connectors of the second row are selectively engagable to respective ones of the snap bases of the second row;

the first swivel connector including a first connector ring which may be selectively captured between any adjacent pair of engaged snap connectors and snap bases of the first rows, and the second swivel connector including a second connector ring which may be selectively captured between any adjacent pair of engaged snap connectors and snap bases of the second rows.

18. An infant carrier configured to be worn by a wearer, the infant carrier comprising:

a seat support configured to support an infant's bottom, the seat support including two openings for the infant's legs and defining a front having a notch formed therein which is sized and configured to provide clearance for the infant's head when the infant is in the infant carrier;

a back support which is integral with the seat support and configured to support the infant's back;

a head support which is integral with the back support and configured to support the infant's head, the head support including a pouch with an opening selectively movable between an open position and a closed position; and a strap support system attached to the seat support and adapted to be worn around the wearer's torso.

19. The infant carrier of claim 18 further comprising a deployable hood which is disposed within the pouch and attached to the head support.

20. The infant carrier of claim 18 further comprising a deployable shroud which is disposed within the pouch and attached to the head support.

21. An infant carrier configured to be worn by a wearer, the infant carrier comprising:

a seat support configured to support an infant's bottom and defining first and second sides;

a back support which is integral with the seat support and configured to support the infant's back;

a head support which is integral with the back support and configured to support the infant's head; and a strap support system which is attached to the seat support and adapted to be worn around the wearer's torso, the strap support system comprising:

an elongate first strap having a first portion attached to the first side of the seat support, and a second end;

a first row of snap bases attached to the first strap;

a first strip of material having a first row of snap connectors attached thereto, the first strip of material being attached to the first strap such that the snap connectors of the first row are selectively engagable to respective ones of the snap bases of the first row;

a first connector piece disposed on the first strap in close proximity to the second end thereof;

an elongate second strap having a first end portion attached to the second side of the seat support, and a second end;

a second row of snap bases attached to the second strap;

a second strip of material having a second row of snap connectors attached thereto, the second strip of material being attached to the second strap such that the snap connectors of the second row are selectively engagable to respective ones of the snap bases of the second row;

a second connector piece disposed on the second strap in close proximity to the second end thereof;

a first mating connector attached to the second side of the seat support; and a second mating connector attached to the first side of the seat support;

the first and second straps being extensible over the wearer's shoulders in a manner wherein the first and second straps criss-cross each other over the wearer's back such that the first connector piece may be interlocked to the first mating connector and the second connector piece may be interlocked to the second mating connector;

first and second swivel connectors used to attach respective ones of the first and second straps to the head support, the first swivel connector including a first connector ring which may be selectively captured between any adjacent pair of engaged snap connectors and snap bases of the first rows, and the second swivel connector including a second connector ring which may be selectively captured between any adjacent pair of engaged snap connectors and snap bases of the second rows.

22. An infant carrier configured to be worn by a wearer, the infant carrier comprising:

a seat support configured to support an infant's bottom and defining first and second sides;

a back support which is integral with the seat support and configured to support the infant's back;

a head support which is integral with the back support and configured to support the infant's head, the head support including a pouch with an opening selectively movable between an open position and a closed position; and a strap support system which is attached to the seat support and adapted to be worn around the wearer's torso, the strap support system comprising:

an elongate first strap having a first portion attached to the first side of the seat support and a second end;

a first connector piece disposed on the first strap in close proximity to the second end thereof;

an elongate second strap having a first end portion attached to the second side of the seat support, and a second end;

a second connector piece disposed on the second strap in close proximity to the second end thereof;

a first mating connector attached to the second side of the seat support; and a second mating connector attached to the first side of the seat support;

the first and second straps being extensible over the wearer's shoulders in a manner wherein the first and second straps criss-cross each other over the wearer's back such that the first connector piece may be interlocked to the first mating connector and the second connector piece may be interlocked to the second mating connector.

23. The infant carrier of claim 22 further comprising a deployable hood which is disposed within the pouch and attached to the head support.

24. The infant carrier of claim 22 further comprising a deployable shroud which is disposed within the pouch and attached to the head support.

25. An infant carrier configured to be worn by a wearer, the infant carrier comprising:

a seat support configured to support an infant's bottom and defining first and second sides;

a back support which is integral with the seat support and configured to support the infant's back;

a head support which is integral with the back support and configured to support the infant's head, the head and back supports being separated by a transition region which is sized and configured to allow the head support to be selectively movable between an unfolded position and a folded position whereat the head support is folded down into an overlapping relation to the back support;

a strap support system which is attached to the seat support and adapted to be worn around the wearer's torso, the strap support system comprising:

an elongate first strap having a first portion attached to the first side of the seat support, and a second end;

a first connector piece disposed on the first strap in close proximity to the second end thereof;

an elongate second strap having a first end portion attached to the second side of the seat support, and a second end;

a second connector piece disposed on the second strap in close proximity to the second end thereof;

a first mating connector attached to the second side of the seat support; and a second mating connector attached to the first side of the seat support;

the first and second straps being extensible over the wearer's shoulders in a manner wherein the first and second straps criss-cross each other over the wearer's back such that the first connector piece may be interlocked to the first mating connector and the second connector piece may be interlocked to the second mating connector; and first and second swivel connectors used to attach respective ones of the first and second straps to the head support and adapted to assist in the movement of the head support between the unfolded and folded positions.

26. The infant carrier of claim 25 further comprising:

a first row of snap bases attached to the first strap;

a first strip of material having a first row of snap connectors attached thereto, the first strip of material being attached to the first strap such that the snap connectors of the first row are selectively engagable to respective ones of the snap bases of the first row;

a second row of snap bases attached to the second strap; and a second strip of material having a second row of snap connectors attached thereto, the second strip of material being attached to the second strap such that the snap connectors of the second row are selectively engagable to respective ones of the snap bases of the second row;

the first swivel connector including a first connector ring which may be selectively captured between any adjacent pair of engaged snap connectors and snap bases of the first rows, and the second swivel connector including a second connector ring which may be selectively captured between any adjacent pair of engaged snap connectors and snap bases of the second rows.

27. An infant carrier configured to be worn by a wearer, the infant carrier comprising:

a seat support configured to support an infant's bottom and defining first and second sides;

a back support which is integral with the seat support and configured to support the infant's back;

a head support which is integral with the back support and configured to support the infant's head, the head and back supports being separated by a transition region which is sized and configured to allow the head support to be selectively movable between an unfolded position and a folded position whereat the head support is folded down into an overlapping relation to the back support, the head support including a pouch with an opening selectively movable between an open position and a closed position; and a strap support system attached to the seat support and adapted to be worn around the wearer's torso.

28. The infant carrier of claim 27 further comprising a deployable hood which is disposed within the pouch and attached to the head support.

29. The infant carrier of claim 27 further comprising a deployable shroud which is disposed within the pouch and attached to the head support.

* * * * *